US009914573B2

(12) United States Patent
Billadeau et al.

(10) Patent No.: US 9,914,573 B2
(45) Date of Patent: Mar. 13, 2018

(54) INTERNAL VENT HANDLE COVER ARRANGEMENT; AND METHODS

(71) Applicant: Planetary Design, Missoula, MT (US)

(72) Inventors: Scott T. Billadeau, Missoula, MT (US); David J. Yakos, Bozeman, MT (US); Joel R. Switzer, Belgrade, MT (US)

(73) Assignee: Planetary Designs, Missoula, MT (US)

( * ) Notice: Subject to any disclaimer, the term of this patent is extended or adjusted under 35 U.S.C. 154(b) by 42 days.

(21) Appl. No.: 14/639,358

(22) Filed: Mar. 5, 2015

(65) Prior Publication Data

US 2016/0257463 A1 Sep. 8, 2016

(51) Int. Cl.

| | |
|---|---|
| ***B65D 51/16*** | (2006.01) |
| ***B65D 81/24*** | (2006.01) |
| *B65D 39/00* | (2006.01) |
| *B65D 39/16* | (2006.01) |

(52) U.S. Cl.

CPC ..... *B65D 51/1683* (2013.01); *B65D 81/245* (2013.01); *B65D 39/0052* (2013.01); *B65D 39/16* (2013.01); *B65D 2205/02* (2013.01)

(58) Field of Classification Search

USPC .. 220/367.1, 580, 756, 578, 203.04, 203.07, 220/233

See application file for complete search history.

(56) References Cited

U.S. PATENT DOCUMENTS

| | | | | |
|---|---|---|---|---|
| 2,096,358 | A | 10/1937 | Gautier | |
| 2,726,012 | A | 12/1955 | Jensen | |
| 2,966,276 | A * | 12/1960 | Hing | A47J 41/02 215/270 |
| 3,578,467 | A | 5/1971 | Huber | |
| 4,303,171 | A * | 12/1981 | Schremmer | B65D 39/12 220/238 |
| 4,942,970 | A * | 7/1990 | Jay | B65D 39/12 215/262 |
| 7,494,025 | B2 | 2/2009 | Porter | |
| 8,807,370 | B2 * | 8/2014 | Lee | B65D 45/327 220/235 |
| 2007/0095849 | A1 * | 5/2007 | Kim | B65D 43/0218 220/803 |
| 2008/0041869 | A1 * | 2/2008 | Backaert | B65D 39/025 220/804 |
| 2011/0278297 | A1 * | 11/2011 | Corti | A23L 3/00 220/232 |

* cited by examiner

*Primary Examiner* — Fenn C Mathew
*Assistant Examiner* — Madison L Poos
(74) *Attorney, Agent, or Firm* — Merchant & Gould P.C.

(57) ABSTRACT

Aspects and techniques of the present disclosure relate to an internal cover/vent handle arrangement, in association with a container, such as a 5 gallon bucket with a slanted sidewall for evacuating air volume above stored material. The disclosure relates to a squeeze-actuated vent valve arrangement arranged and configured to be easily operated even while deeply recessed in the bucket. The disclosure also relates to a deflectable outer seal arrangement configured to seal against a slanted sidewall of a bucket.

16 Claims, 11 Drawing Sheets

INTERNAL VENT HANDLE COVER ARRANGEMENT; AND METHODS

TECHNICAL FIELD

The present disclosure relates generally to cover members or lids for enclosing contents in a container. More specifically, the present disclosure relates to cover members having vent handle arrangements thereon.

BACKGROUND

Various materials (i.e., solids and/or liquids) can be transported in containers, such as, for example, cans or buckets. Often the containers are provided with a cover for allowing access to the contents within. As a portion of the material is removed, it is sometimes desired to evacuate the air above the contents while reclosing the container to preserve the freshness of the contents stored in the container. The excess air in the container can cause the contents to become oxidized and lead to staleness. Internal vent cover arrangements have been developed to do this. Examples, such as covers or lids, are disclosed in U.S. Pat. Nos. 7,494,025; 3,578,467; and 2,726,012; the complete disclosures of these references are incorporated herein by reference.

Improvements in covers or lids relating to venting and use, are desirable.

SUMMARY

One aspect of the present disclosure relates to an internal cover/vent handle arrangement for enclosing contents in a container. The internal cover/vent handle arrangement includes a main cover body that can have an outer perimeter; and, opposite exterior and interior surfaces. The internal cover/vent handle arrangement can include a vent arrangement that extends through the main cover body. A vent handle arrangement is provided that includes a handle member; and, a squeeze-actuated vent valve arrangement configured to have a first, open, squeezed orientation in which the vent arrangement is open to permit a passage of air through the main cover body; and, a second, closed, release orientation in which the vent arrangement is closed to the passage of air through the main cover body. The internal cover/vent handle arrangement further can include a deflectable outer seal arrangement oriented in extension around the outer perimeter of the main cover body. The deflectable outer seal arrangement can include a deflectable perimeter flange arrangement that can have a rest shape that extends non-orthogonal to a direction between the exterior and interior surfaces of the main cover body.

DETAILED DESCRIPTION

I. Further Regarding Selected Prior Practices

Use of cover arrangements of the type characterized in U.S. Pat. No. 7,494,025 B2, is limited because of how they are configured for proper operation. This is because the design, as explained in U.S. Pat. No. 7,494,025 B2, is configured to be used specifically with a cylindrical wall, not a tapered wall, so it is limited in its application.

Also, cover arrangements of the type characterized in U.S. Pat. No. 7,494,025 B2, require that a handle rotate between upper and lower positions (i.e., during venting and closing). Thus, the handle must be kept free of material that may interfere with it. Also, this can be cumbersome to manage, if the cover arrangement is used inside a deep receptacle. For example, when using a 5 gallon bucket, a larger cover arrangement is used. Typically, a large cover arrangement will have a tendency to tilt when inside the 5 gallon bucket, and using a rotatable or hinged cover will exasperate the tilt.

Improvements are provided herein that can be applied differently from the arrangements explained in U.S. Pat. No. 7,494,025 B2, for example. These improvements and techniques are described below.

Figure 1:
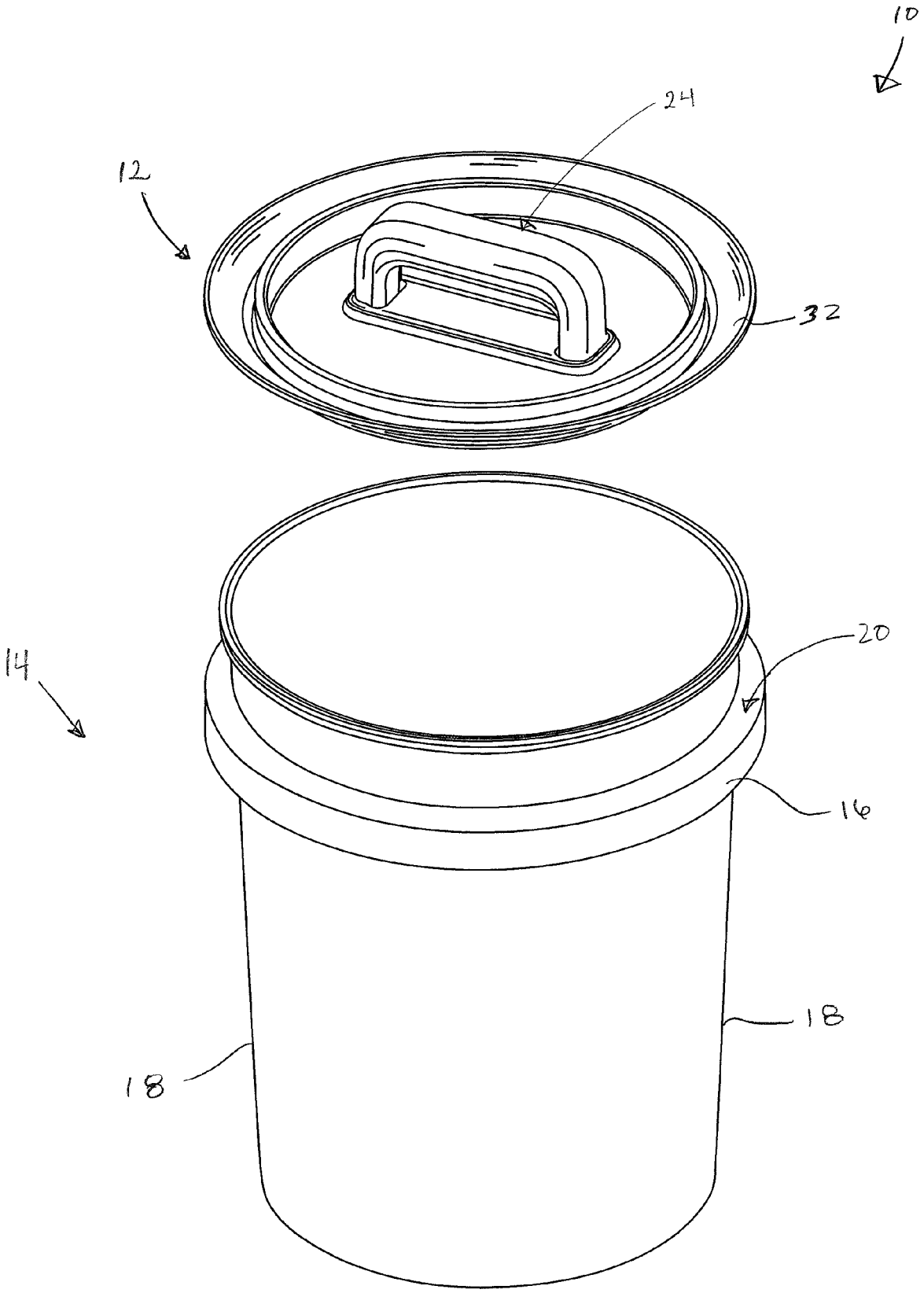
FIG. 1 is a schematic perspective view of an example package assembly including a cover member and a container in accord with the principles of the present disclosure.
Figure 2:
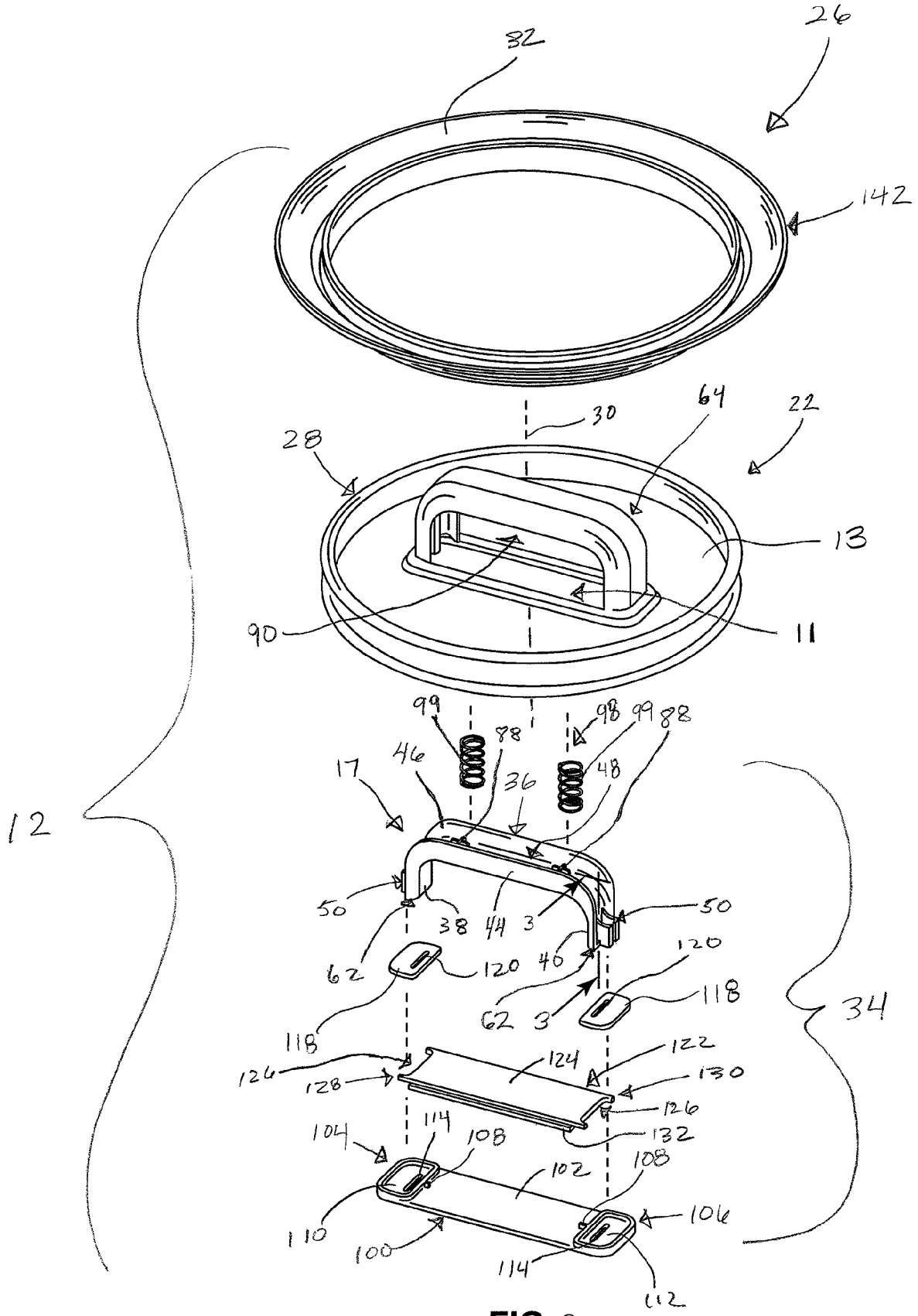
FIG. 2 is a schematic exploded perspective view of the cover member shown in FIG. 1.
Figure 3:
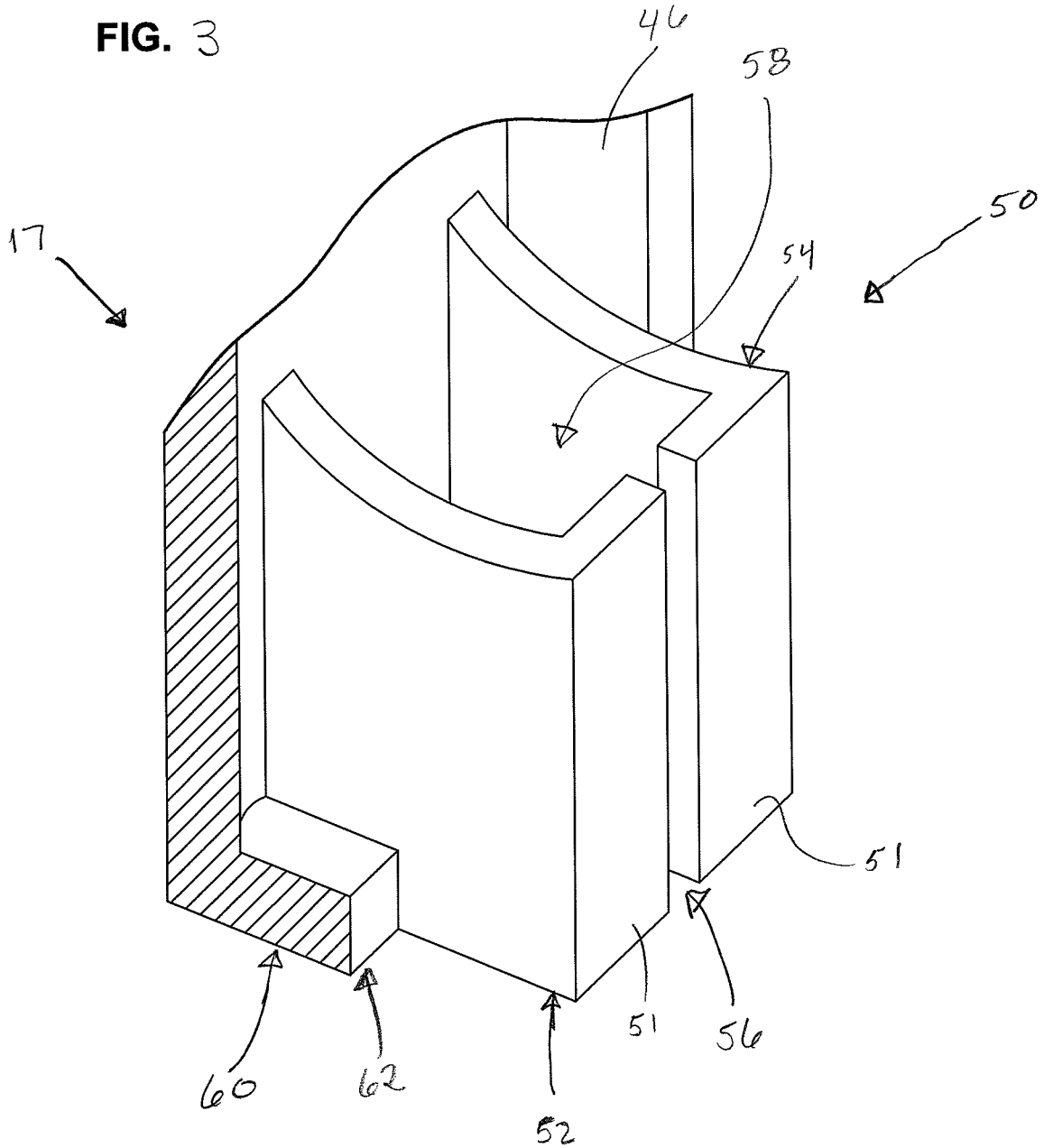
FIG. 3 is an enlarged schematic cross-sectional view taken generally along line 3-3, FIG. 2; of a squeeze actuated valve member in accordance with the principles of the present disclosure.

II. An Improved Assembly; FIGS. 1-3

A. General

In general, 5 gallon pails or buckets, or other types of containers, are widely used to store and/or ship various materials. A 5 gallon bucket will be the preferred container in the examples of the present disclosure provided herein, although alternatives are possible. Typically, a bucket can be used to store contents (solids or liquids) that are atmosphere sensitive. In particular, a bucket can be used to keep the air volume above stored material relatively low so that the atmosphere sensitive contents within the bucket are not affected.

Such a bucket, FIG. 1, can have a number of features characterized herein, although alternatives are possible. First, the bucket can be configured with a slanted sidewall that tapers inwardly from a top of the bucket towards a bottom of the bucket by as much as an inch; i.e. with a slanted wall tapered inwardly at a slant of at least 0.5°, typically 1° to 8°. The internal covers of the type characterized in U.S. Pat. No. 7,494,025 B2 would not work with such a configuration because those covers are not configured to seal or conform to slanted sidewalls of a container.

Second, the bucket will typically have a rim positioned generally around a portion of the bucket to permit empty buckets to be stacked before or after use and easily separated without sticking together in absence of a lid. Third, the bucket will typically have a handle (not shown in FIG. 1) secured on it. Fourth, the bucket can include an exterior lid or cover (not shown in FIG. 1) that can be secured on the bucket during storage or shipment. Such a cover could be removed to access the contents within the bucket.

As the material inside the bucket is removed, there is sometimes a desire to have an internal cover that can be pushed down inside the bucket, toward the material, in order to vent out extra atmosphere from above the material stored inside the bucket. This helps to keep the contents within the bucket fresh and free from oxidation. A feature of the present disclosure is that features, for venting atmosphere inside containers, are provided that can, if desired, be used with a variety of arrangements.

The example internal cover/vent handle arrangement is an improvement because it allows for advantageous venting from immediately above the material so that the material is less exposed to air, even in slanted wall, deep, buckets. The internal cover/vent handle arrangement, according to the present disclosure, is different in two primary ways. First, a squeeze-actuated vent valve arrangement, that allows air to vent from a bucket, is arranged and configured to be easily operated even while deeply recessed in the bucket, without the potentially cumbersome step of moving valves, by, for example, having to rotate a handle. Second, the internal cover/vent handle arrangement disclosed is also an improvement because it has a seal arrangement that can manage slanted walls.

A vent handle arrangement, as characterized herein, includes a handle member and a squeeze-actuated vent valve arrangement, although alternatives are possible. In general, the vent handle arrangement can be gripped by a user to easily trigger and move the vent handle arrangement to a first, open, squeezed orientation; and, a second, closed, release orientation. This configuration is convenient because there is no need to rotate or move up or down the vent handle arrangement. Also, the vent handle arrangement can be easily accessed deep inside the bucket to vent atmosphere by a simply using one hand to trigger the vent handle arrangement. This type of vent handle arrangement can be used with any type of seal to allow for a variety of arrangements. The vent handle arrangement will be described in further detail below.

Again, a deflectable outer seal arrangement can be configured to seal to a slanted sidewall of a bucket, although alternatives are possible. The deflectable outer seal arrangement preferably includes a deflectable perimeter flange arrangement that has a rest shape (shape when not installed) that extends non-orthogonal to a direction of a main cover body of the internal cover/vent handle arrangement. As a result, the deflectable perimeter flange arrangement is configured to seal against a changing diameter of a bucket. Of course, such deflectable perimeter flange arrangement can be used to seal against non-slanted surfaces, but it is particularly desired for slanted wall containers.

The deflectable outer seal arrangement of the internal cover/vent handle arrangement can be used together with the vent handle arrangement or different type of vent valve.

B. An improved Vent Valve Arrangement; FIGS. 1-3

The reference numeral 10, FIG. 1, generally indicates a packaging assembly 10 and depicts an improved internal cover/vent handle arrangement 12, in accord with the present disclosure, in association with a container 14, such as a 5 gallon bucket with a slanted sidewall.

The example internal cover/vent handle arrangement is an improvement over the types of valve arrangements described in U.S. Pat. No. 7,494,025 B2, because the improved internal cover/vent handle arrangement does not have to be rotated between venting and closing positions such that it can interfere with contents or materials within a bucket.

In the example depicted, the container 14 includes an optional rim element 16 that extends from a sidewall 18 of the container 14 and forms a flat annular ledge 20. The rim element 16 can be integral with (e.g., forming in one piece with) or coupled to, the container 14, although alternatives are possible. Such a structure permits empty containers to be stacked without sticking in absence of a lid (not shown). In certain examples, the container 14 may include a handle (not shown). An inner surface 146 of the sidewall 18 of the container 14 can include a tapered portion 152, FIG. 9.

Referring to FIGS. 2-3, the example improved internal cover/vent handle arrangement 12 includes a main cover body 22 having an outer perimeter 28 that extends around the main cover body 22, a vent arrangement 11 extending through the main cover body 22, a vent handle arrangement 24 (FIG. 1), and a deflectable outer seal arrangement 26. The main cover body 22 is depicted as having a circular perimeter, although alternatives are possible.

In the example depicted, the vent arrangement 11 is shown as an opening that permits air to flow from outside the container 14 to inside the container 14 (when the improved internal cover/vent handle arrangement 12 is lifted) and air to flow from inside the container 14 to outside the container 14 (when the improved internal cover/vent handle arrangement 12 is pushed downward).

The example vent handle arrangement 24 shown includes a handle member 64 (i.e. stationary handle member) and a squeeze-actuated vent valve arrangement 34, although alternatives are possible. Herein, the term "stationary" is generally used to mean that there is no movement of the components, relative to other parts of the main cover body 22, when grasped. In other words, the handle member 64 is fixed.

Figure 4:
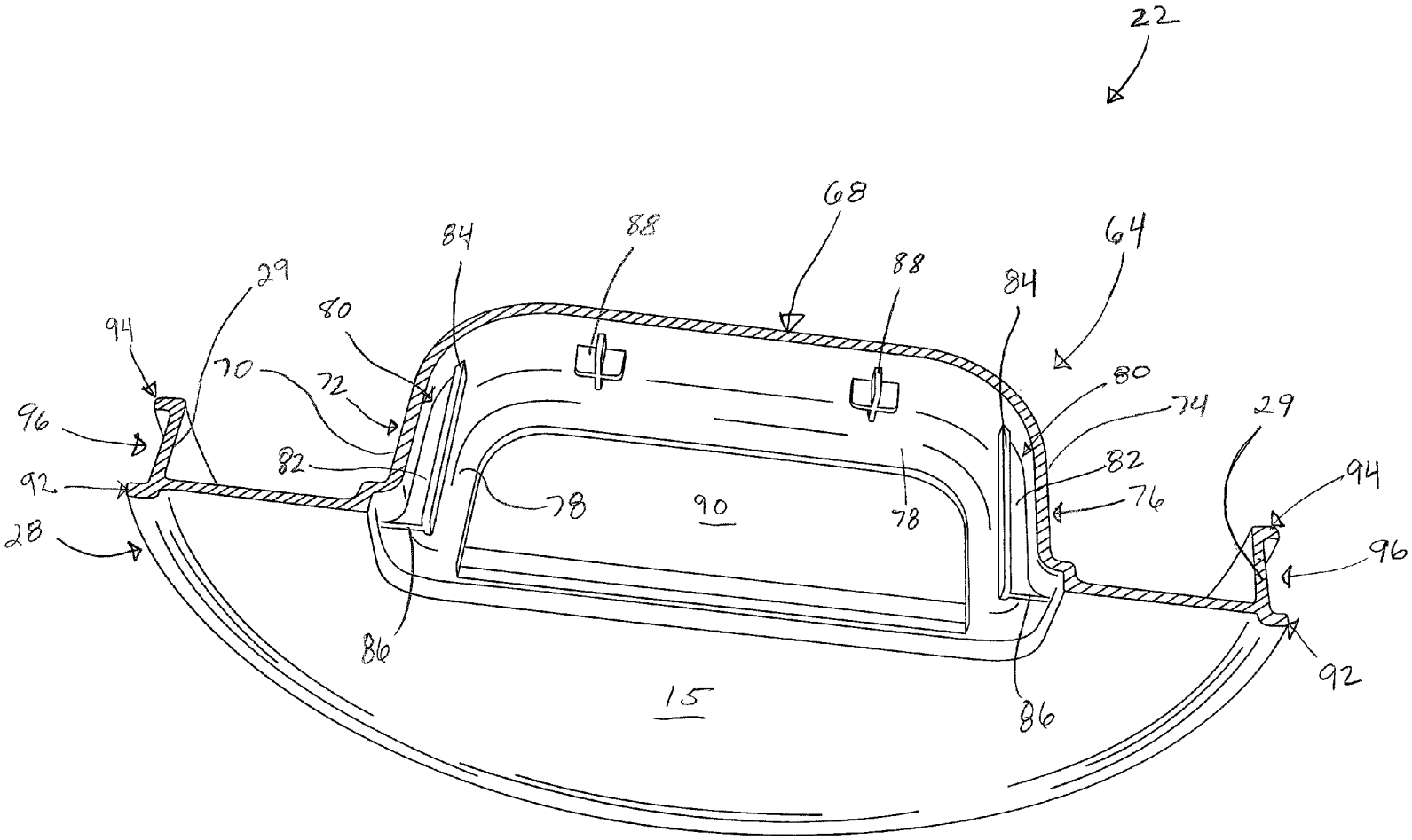
FIG. 4 is a schematic bottom cross-sectional view of a main cover body of the cover member shown in FIG. 2.

The handle member 64 is positioned on the exterior surface 13 of the main cover body 22, although alternatives are possible. In FIG. 4, the example handle member 64 shown defines a bridge portion 68 (e.g., handle bridge) extending between a first support 70 extending downwardly from the bridge portion 68 at a first side 72, and an opposite second support 74 extending downwardly from the bridge portion 68 at a second side 76, but alternatives are possible. Herein, the term "bridge portion" generally means a configuration allowing a person to get a portion of their fingers thereunder to grasp the vent handle arrangement 24. For example, the example bridge portion 68 shown defines an opening 90 therethrough to allow a user to grip the handle member 64 and the moveable, squeeze-actuated, valve member 17 together to actuate the vent valve arrangement 24. The example bridge portion 68 can be integral with (e.g., formed in one piece with) or coupled to the first and second legs 70, 74, although alternatives are possible.

Figure 8:
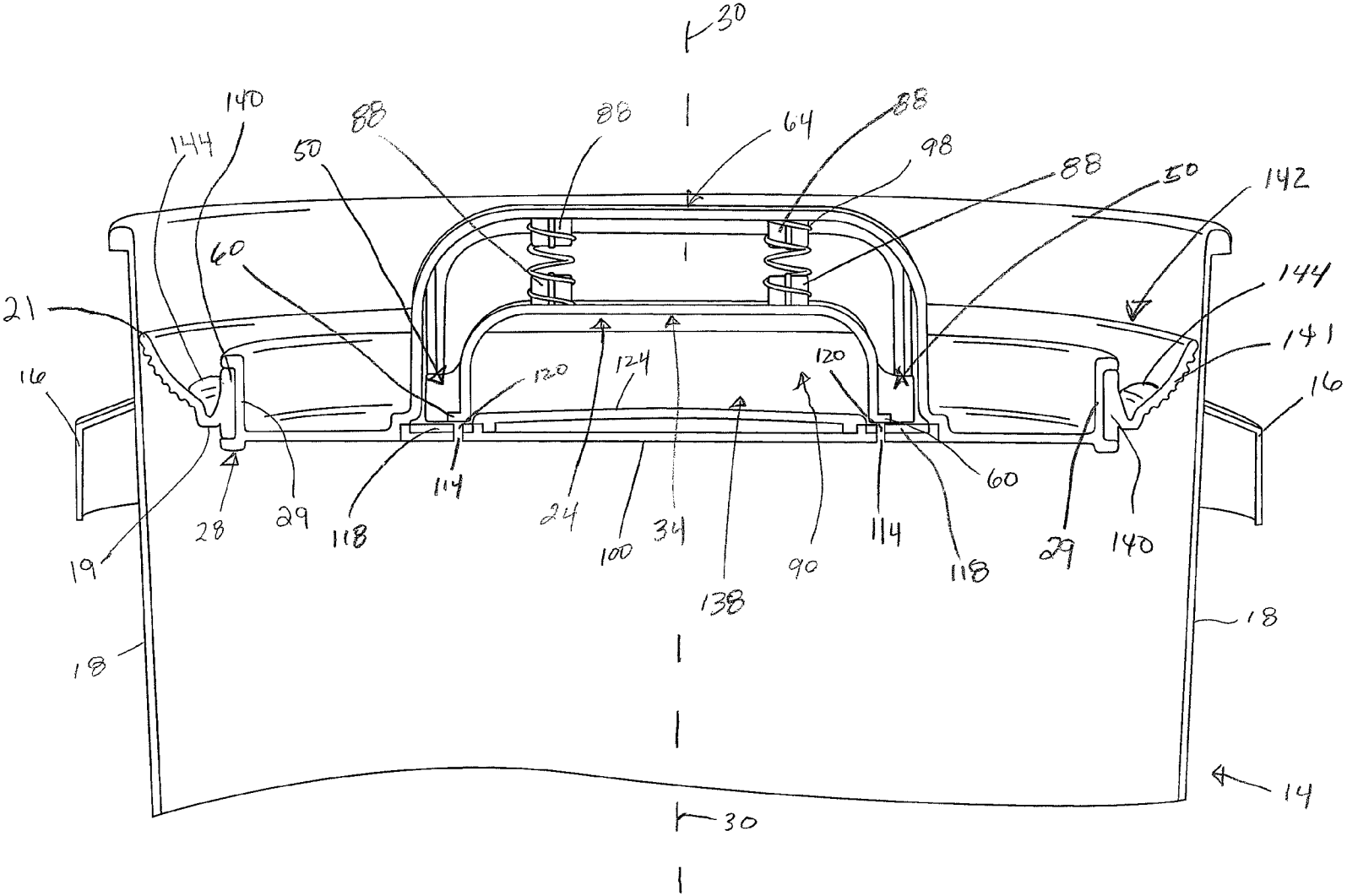
FIG. 8 is a schematic cross-sectional view of the cover member inside the container with the vent valve arrangement in a closed orientation in accordance with the principles of the present disclosure.

The example squeeze-actuated vent valve arrangement 34 shown includes a moveable, squeeze-actuated, valve member 17 that is positionable between a portion of the handle member 64 and the vent arrangement 11. The handle member 64 and the moveable, squeeze-actuated, valve member 17 are configured such that an operator or user can simultaneously grip the handle member 64 and the moveable, squeeze-actuated, valve member 17 together to squeeze and move the vent handle arrangement 24 to a first, open, squeezed orientation 136 (see FIG. 6); and, release to move the vent handle arrangement 24 to a second, closed, release orientation 138 (see FIG. 8).

In the first, open, squeeze orientation 136, the vent handle arrangement 24 is opened to permit a passage of air flow 116 through the main cover body 22. In the second, closed, release orientation 138, the vent handle arrangement 24 is closed to block a passage of air flow 116 through the main cover body 22.

Turning again to FIG. 2, the example vent valve arrangement 24 shown includes a biasing arrangement 98 (e.g., springs) to bias the moveable, squeeze-actuated, valve member 17 to the second, closed, orientation 138 when released.

The moveable, squeeze-actuated, valve member 17 includes at least one seal pad 60 (see FIG. 3) configured to be biased against at least a portion of the vent arrangement 11 and close it when the vent handle arrangement 24 is in a second, closed, release orientation. In the example arrangement, the moveable, squeeze-actuated, valve member 17 shown includes two seal pads 60 located at free ends 62 of the moveable, squeeze-actuated, valve member 17, although alternatives are possible.

The example vent handle arrangement 24 shown also includes resilient seal arrangements 118 (FIG. 2) through which the vent arrangement 11 extends. The seal pads 60 of the movable, squeeze-actuated, valve member 17 engage the resilient seal arrangements 118, to facilitate closure of the vent arrangement 11, when the vent handle arrangement 24 is in a second, closed, release orientation 138.

Figure 6:
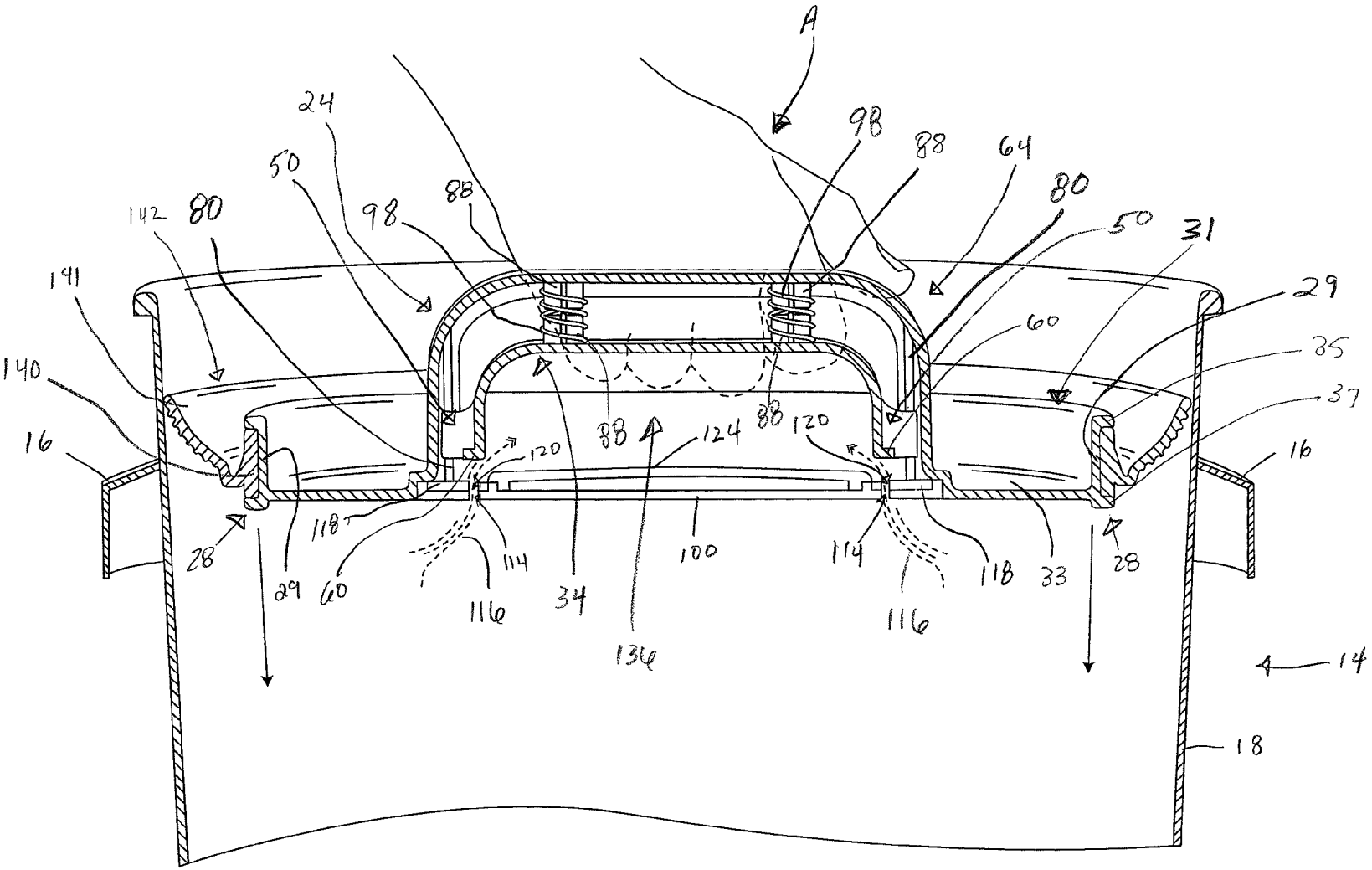
FIG. 6 is a schematic cross-sectional view of the cover member being pushed down inside the container with the vent valve arrangement actuated in an open orientation in accordance with the principles of the present disclosure.

Referring to FIG. 6, the example internal cover/vent handle arrangement 12 is shown being pushed down into the container 14 to vent atmosphere immediately above the material.

Figure 7:
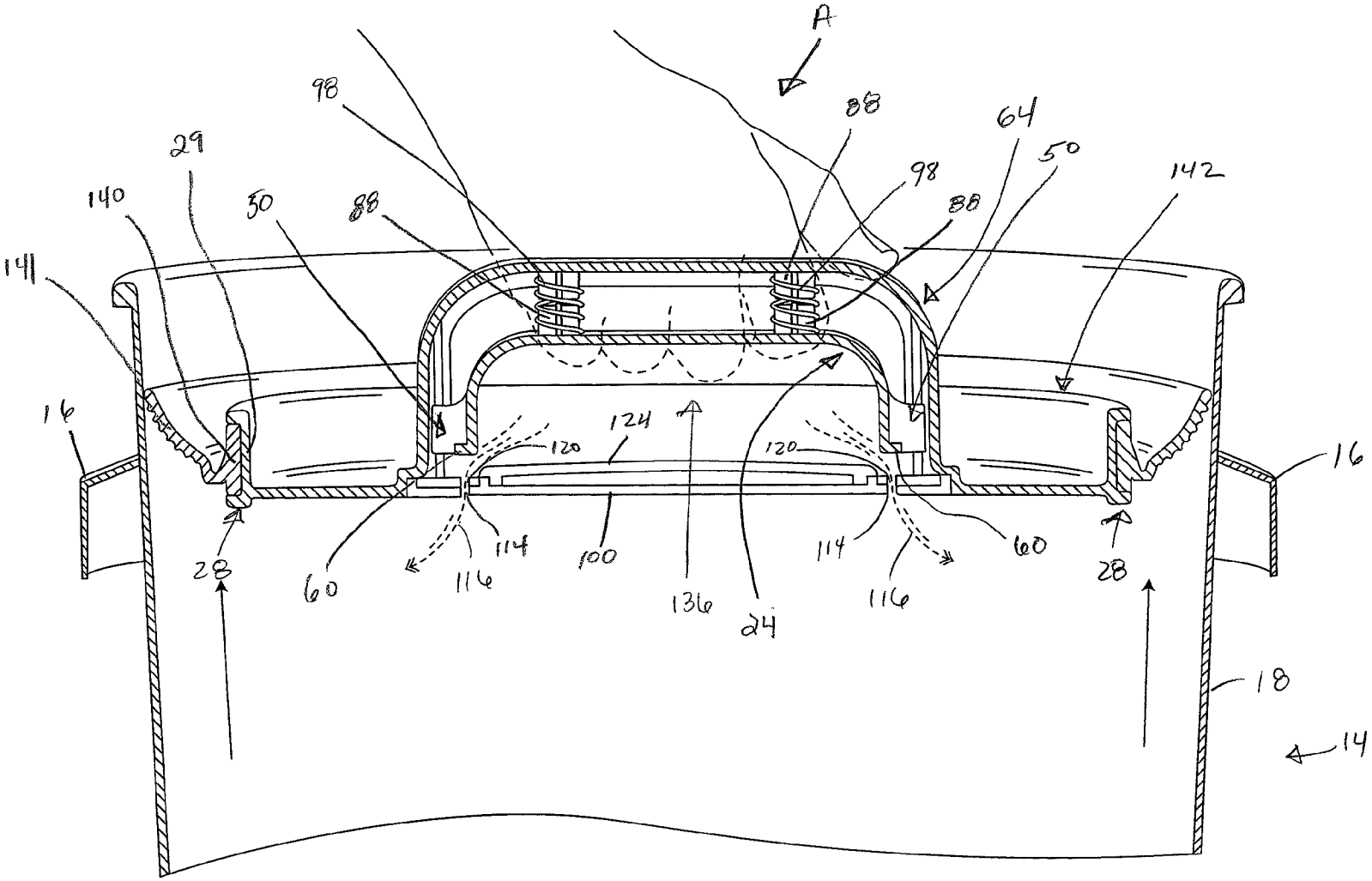
FIG. 7 is a schematic cross-sectional view of the cover member being pulled up inside the container with the vent valve arrangement actuated in an open orientation in accordance with the principles of the present disclosure.

Referring to FIG. 7, the internal cover/vent handle arrangement 12 is shown being pulled up to remove the internal cover/vent handle arrangement 12 to access the material within the container 14.

The example vent handle arrangement 24, according to the present disclosure, can be used with a variety of seal arrangements.

C. An Improved Deflectable Outer Seal Arrangement

Figure 9:
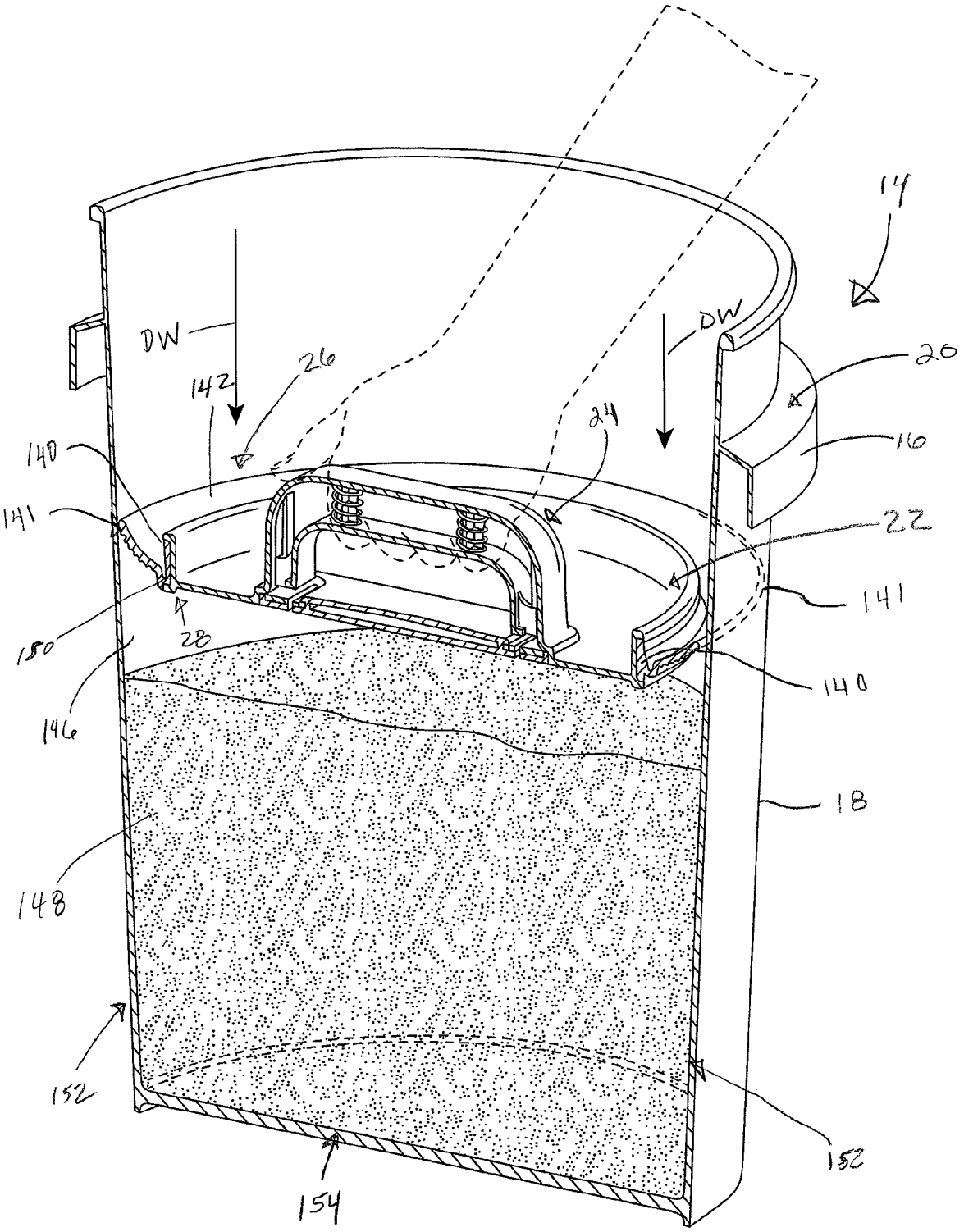
FIG. 9 is a schematic cross-sectional view of the packing assembly with the cover member shown in FIG. 6 recessed in a container toward material stored therein.
Figure 10:
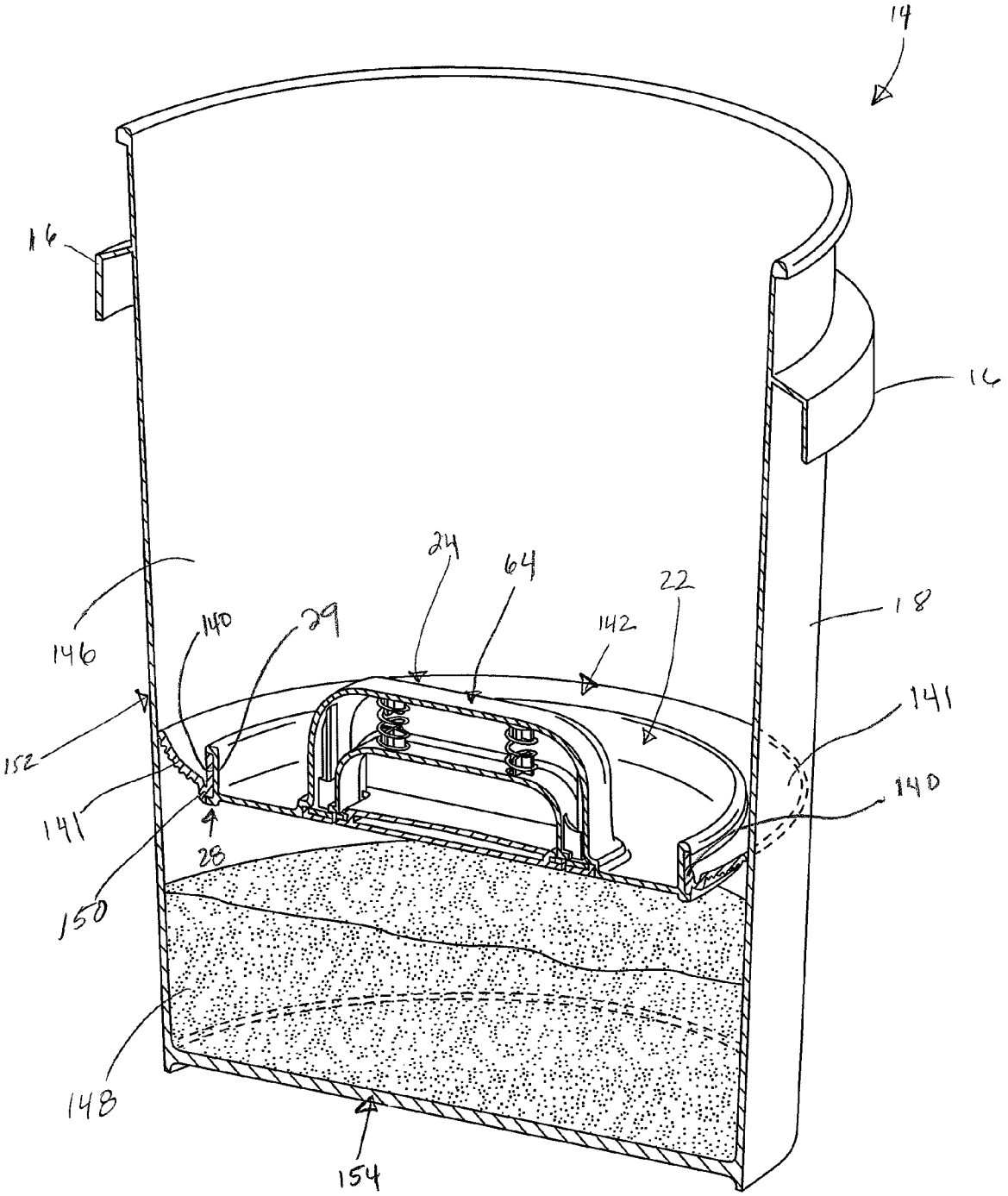
FIG. 10 is a schematic cross-sectional view of the packing assembly with the cover member shown in FIG. 9 lowered further into the container due to the container including less material therein, relative to FIG. 9.

Referring to FIGS. 9-10, an example deflectable outer seal arrangement 26 is shown, oriented in extension around the outer perimeter 28 of the main cover body 22.

In general, the example deflectable outer seal arrangement 26 shown includes a deflectable perimeter flange arrangement 142. The deflectable perimeter flange arrangement 142 depicted includes a seal member portion 141 and an attachment base 140. The attachment base 140 surrounds, and is secured to, the outer perimeter wall 29 of the main cover body 22. The attachment base 140 of the example deflectable outer seal arrangement 26 shown is configured to be received within a recess groove 96 (see FIG. 4) of the outer perimeter wall 29, although alternatives are possible.

The deflectable perimeter flange arrangement 142 is integral with (e.g., forming in one piece with) or coupled to, the attachment base 140. The example deflectable outer seal arrangement 26 has a circular shape.

The deflectable perimeter flange arrangement 142 is configured with a rest shape that extends non-orthogonal to a direction between the exterior and interior surfaces 13, 15 of the main cover body 22.

The deflectable perimeter flange arrangement 142 depicted is configured to form an upper acute angle of extension 144 (see FIG. 8), in a rest shape, relative to the central axis 30, although alternatives are possible. Herein, the term "rest shape" generally means that the deflectable perimeter flange arrangement 142 has a non-deformed shape that projects outwardly at an angle 144 relative to the attachment base 140, when not installed. Also, the delectable perimeter flange arrangement 142 is configured to seal against slanted wall containers when installed.

The example deflectable perimeter flange arrangement 142 shown is not necessarily of a straight, conical, shape of extension. For example, as depicted, the deflectable perimeter flange arrangement 142 is bowed having a somewhat upper, concave, surface 23 and an opposite, lower, convex sealing surface 25.

The example deflectable perimeter flange arrangement 142 shown provides a sliding seal along a slanted inner surface 146 of the sidewall 18 of the container 14. The example deflectable perimeter flange arrangement 142 shown can be used with a variety of alternate vent arrangements and alternate containers, including cans and/or jars.

D. Selected Features and Variations

1. Vent Valve Arrangement

Turning again to FIG. 2, the example vent valve arrangement 24 shown includes a cap member 100 that has a base 102, a first end 104 and an opposite second end 106. The base 102 includes ribs 108 at the first and second ends 104, 106 of the cap member 100 that extend upwardly from the base 102. The ribs 108 provide an attachment mechanism, for example, an optional snap-fit mechanism, to seal or close off the vent arrangement 11 in the main cover body 22. Adhesive can also be used for securing an assembly.

The example cap member 100 shown defines a recess 110 at the first end 104 and a recess 112 at the second end 106 that are located adjacent to the ribs 108. As shown, the recesses 110, 112 each define apertures 114 for the passage of air flow 116 (see FIG. 6) through the main cover body 22.

Figure 5:
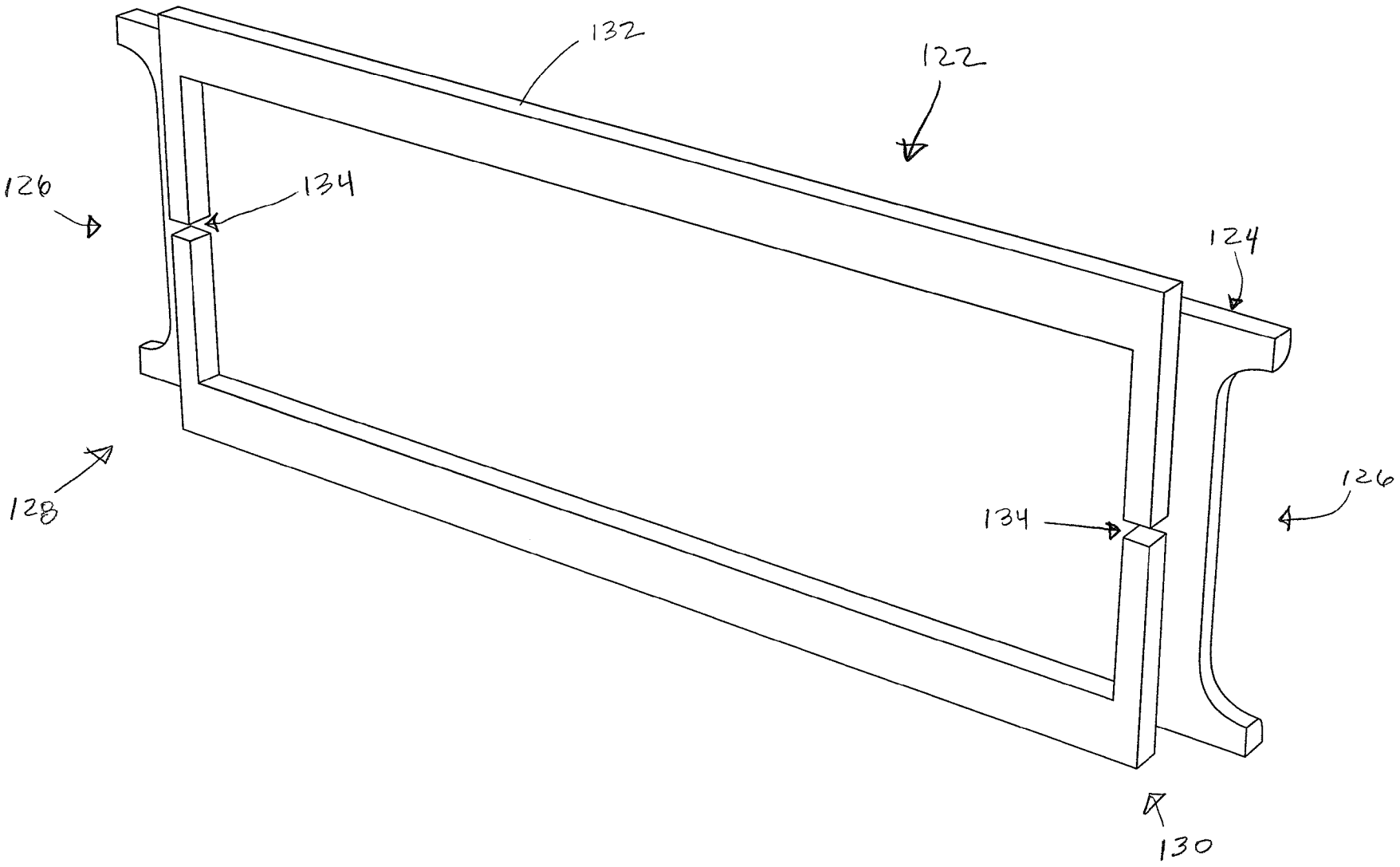
FIG. 5 is a schematic enlarged bottom perspective view of a closure or containment member of a vent valve arrangement in accordance with the principles of the present disclosure.

It is desired to have the resilient seal arrangement 118 in an appropriate place for the internal cover/vent handle arrangement 12 to work. To do that, the example vent valve arrangement 24 shown includes a platform member 122 that has a body 124. The body 124 defines cutouts 126 on opposing sides 128, 130 of the body 124. The example platform member 122 shown includes a frame 132 (see FIG. 5) that defines gaps 134 positioned adjacent to the cutouts 126 on each of the opposing sides 128, 130, although alternatives are possible. The example gaps 134 shown are configured to receive the ribs 108 on the base 102 of the cap member 100. The resilient seal arrangement 118 is configured to be received within the recesses 110, 112 of the cap member 100 to be held therein. The example platform member 122 is arranged and configured to mate with the cap member 100. Such an arrangement allows the components of the vent valve arrangement 24 to be held in place so that the internal cover/vent handle arrangement 12 will operate properly.

As shown, the resilient seal arrangement 118 includes slits 120 that align with the apertures 114 in the recesses 110, 112 to allow for the passage of air flow 116 therethrough, although alternatives are possible. The resilient seal arrangements 118, when used, will typically comprise a resilient material, such as, for example silicone rubber.

The seal pads 60 cover or seal the apertures 114 and the slits 120 to close a portion of the vent arrangement 11 extending therethrough, when the vent handle arrangement 24 is in a second, closed, release orientation 138. The vent arrangement 11 can include a plurality of vent openings and the movable, squeeze-actuated, valve member 17 can have a plurality of seal pads 60, for example with one each configured to close an associated one each of the vent openings, when the vent handle arrangement 24 is in a second, closed, release orientation. Of course, one pad 60 can be configured to close more than one vent opening.

The example squeeze-actuated vent valve arrangement 34 shown includes a moveable, squeeze-actuated, valve member 17 that has a support bar 36, a first leg 38 extending downwardly from the support bar 36, and an opposing second extending leg 40 extending downwardly from the support bar 36, although alternatives are possible. The example moveable, squeeze-actuated, valve member 17 shown includes seal pads 60 at free ends 62 of both of the respective first and second extending legs 38, 40. The seal pads 60 shown can be integral with (e.g., formed in one piece with) or coupled to, the two opposing upright walls 44, 46.

The example support bar 36 shown is integral with (e.g., formed in one piece with) or coupled to, the first and second extending legs 38, 40. The support bar 36 has two opposing upright walls 44, 46 extending therefrom that together form a channel 48 therebetween.

Referring to FIG. 3, an enlarged schematic cross-sectional view taken generally along line 3-3, FIG. 2 is shown. The example moveable, squeeze-actuated, valve member 17 shown includes a slide mechanism 50 configured on the first and second extending legs 38, 40 respectively. The slide mechanism 50 includes a first arm member 52 and an opposite second arm member 54. The first and second arm members 52, 54 each has a tab member 51 extending generally at a right angle therefrom. The tab members 51 of the respective first and second arm members 52, 54 together define a pass-through slot 56 and a pocket 58 in the example slide mechanism 50.

Referring to FIG. 4, the example handle member 64 shown also includes projections 80. The projections 80 shown each has a main body 82 with a guide member 84 and an edge member 86 that is generally perpendicular to the guide member 84. When the example moveable, squeeze-actuated, valve member 17 shown is actuated, the edge member 86 is arranged and configured to engage the pass-through slot 56 of the slide mechanism 50, and the guide member 84 is arranged and configured to be received within the pocket 58 of the slide mechanism 50 to facilitate the actuation of the moveable, squeeze-actuated, valve member 17.

Upon actuation of the vent valve arrangement 24, the at least one seal pad 60 is raised or lifted to allow for the passage of air flow 116 through the vent arrangement 11. The at least one seal pad 60 closes a portion of the vent arrangement 11 through both the apertures 114 of the cap member 100 and the slits 120 of the resilient seal arrangements 118. In the second, closed, release orientation 138, the seal pad 60 is lowered to cover the apertures 114 of the cap member 100 and the slits 120 of the resilient seal arrangements 118 to block air flow 116 therethrough, such that the passage of air flow 116 through a portion of the vent arrangement 11 is closed.

The outer perimeter 28 of the main cover body 22 extends around a central axis 30 (FIG. 2). The central axis 30 is perpendicular to a central plane of the main cover body 22. In general, the main cover body 22 includes an exterior surface 13, and an opposite interior surface 15 (FIG. 4). The main cover body 22 includes an outer perimeter wall 29, an upper end 31 (FIG. 6) and a central surface portion 33 (FIG. 6). The central surface portion 33 shown is recessed relative to the upper end 31 of the main cover body 22.

The outer perimeter wall 29 of the main cover body 22 includes an upper, radially outwardly extending, projection 94 and an opposite lower, radially outwardly extending, projection 92 with a peripheral, recessed, groove 96 therebetween. The upper and lower projections 92, 94 are parallel to one another as they extend radially outward from the main cover body 22.

Turning again to FIGS. 2 and 4, the example moveable, squeeze-actuated, valve member 17 and the example handle member 64 each include tab members 88. The tab members 88 are positioned on the support bar 36 of the squeeze-actuated vent valve arrangement 34 and are integral with (e.g., forming in one piece with) or coupled to, the support bar 36. The example tab members 88 shown are also formed on the bridge portion 68 of the handle member 64, and are integral with (e.g., forming in one piece with) or coupled to, the bridge portion 68.

The example vent valve arrangement 24 further includes a biasing arrangement 98 arranged and configured over tab members 88 located on both the squeeze-actuated vent valve arrangement 34 and the handle member 64 for resiliently biasing the moveable, squeeze-actuated, valve member 17 to a second, closed, orientation. In the example depicted, the biasing arrangement 98 includes at least one coil spring 99 (FIG. 2) and as shown, two coil springs 99. The coil springs 99 are held in place by the tab members 88.

2. Deflectable Outer Seal Arrangement

The upper acute angle of extension 144 (FIG. 8), in the rest shape, of the deflectable perimeter flange arrangement 142 is within the range of 10° to 80°, inclusive. Typically, the upper acute angle of extension 144, in the rest shape, of the deflectable perimeter flange arrangement 142 is within the range of 30° to 60°, inclusive.

Figure 11B:
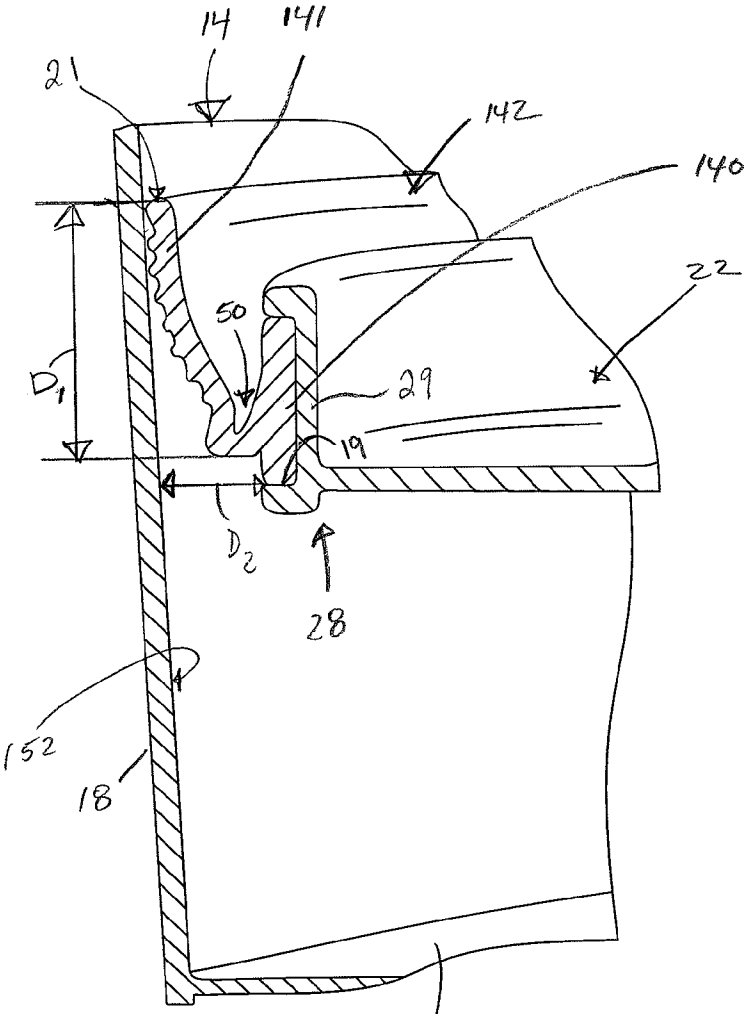
FIG. 11B is a schematic partial cross-sectional view of the cover member shown in FIG. 3 positioned recessed toward a bottom of the container, relative to FIG. 11A.
Figure 11A:
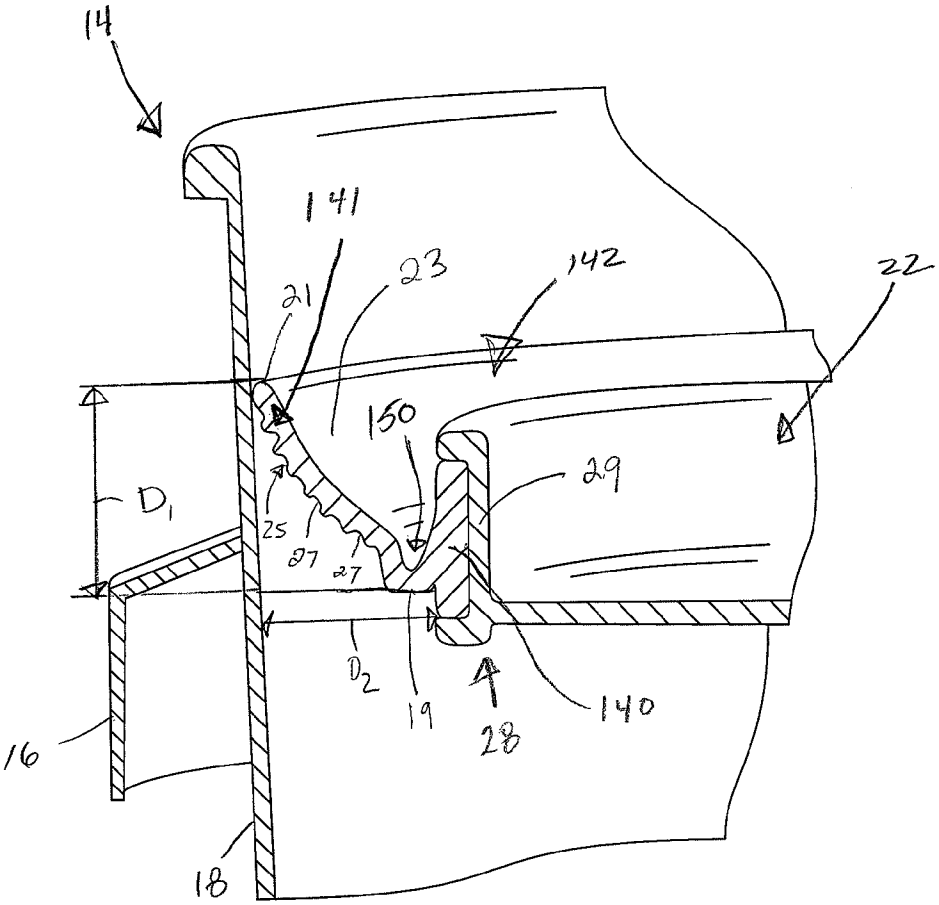
FIG. 11A is schematic a partial cross-sectional view of the cover member shown in FIG. 3 positioned near a top of the container.

Referring to FIGS. 11A, 11B, the example deflectable perimeter flange arrangement 142 shown includes a base end 19 and an outer remote end 21. The outer remote end 21 of the deflectable perimeter flange arrangement 142 defines a circular shape. The example deflectable perimeter flange arrangement 142 shown extends between the base end 19 and the outer remote end 21 over a distance $D_1$ of at least 10 mm, although alternatives are possible. Often, the example deflectable perimeter flange arrangement 142 shown extends between the base end 19 and the outer remote end 21 over a distance $D_1$ of no more than 100 mm, although alternatives are possible. Usually, the example deflectable perimeter flange arrangement 142 shown extends between the base end 19 and the outer remote end 21 over a distance $D_1$ within the range of 10 mm to 60 mm, although alternatives are possible. Typically, the example deflectable perimeter flange arrangement 142 shown extends between the base end 19 and the outer remote end 21 over a distance $D_1$ of at least 10 mm and no more than 40 mm.

The example deflectable perimeter flange arrangement 142 has a radial outward dimension of extension $D_2$ of at least 10 mm. Typically, the deflectable perimeter flange arrangement 142 has a radial outward dimension of extension $D_2$ of no more than 80 mm. Often, the deflectable perimeter flange arrangement 142 has a radial outward dimension of extension $D_2$ of at least 10 mm and no more than 60 mm. (preferably no more than 40 mm or 50 mm.)

The example deflectable perimeter flange arrangement 142 and the attachment base 140 shown define a pivot point 150 around which the deflectable perimeter flange arrangement 142 flexes when sealing against the slanted inner surface 146 of the sidewall 18.

The deflectable perimeter flange arrangement 142 can include a unitary skirt member 32 (see FIG. 1) that has a thickness of at least 0.005 mm, not greater than 10 mm, and typically within the range of 0.01-5.0 mm.

The deflectable perimeter flange arrangement 142 has an upper surface 23 and an opposite, lower sealing surface 25. The lower sealing surface 25 includes a plurality of radial ribs 27 thereon. When the main cover body 22 is inserted within the container 14, the deflectable perimeter flange arrangement 142 is configured to seal against the sidewall 18 of the container 14.

The deflectable outer seal arrangement 26 can be formed from a molded plastic (i.e., polypropylene), although alternatives are possible. The advantage of forming the deflectable outer seal arrangement 26 as a molded plastic is the ability to easily form various shapes and sizes of the deflectable outer seal arrangement 26.

E. General Method

In accord with the present disclosure, a method of venting a container including: squeezing a vent handle arrangement configured on an internal cover; and pushing the internal cover along an inside of a container with a slanted sidewall while the internal cover is in sealing engagement with the slanted sidewall. These techniques can be practiced with the specific arrangements shown, but alternatives are possible.

Again, the principles, techniques, and features described herein can be applied in a variety of arrangements, and there is no requirement that all of the advantageous features identified be incorporated in an assembly, arrangement or component to obtain some benefit according to the present disclosure.

F. Example Uses

In accord with the present disclosure, the improved internal cover/vent handle arrangement can be used with containers to store a variety of items. These items can be commercial uses, hardware uses, home uses, farm/ranch uses, or military uses. For example, items that can be stored include items that will degrade through contact with air such as food including: coffee, rice, seed, farm animal feed (cat, horse, etc.) or hardware items such as paint.

Some General Observations; Summary

The present disclosure relates to two general concepts. One concept relates to a vent handle arrangement having a squeeze-actuated vent valve arrangement that provides for venting from immediately above material in a bucket, even in slanted wall, deep, buckets. Another concept relates to a deflectable outer seal arrangement that can provide a sealing engagement with a slanted sidewall of a container. In this summary, some selected, final summary characterizations of the teachings herein are provided. Among them are:

1. An internal cover/vent handle arrangement for enclosing contents in a container, the internal cover/vent handle arrangement comprising: a main cover body having: an outer perimeter; and, opposite exterior and interior surfaces; a vent arrangement extending through the main cover body; a vent handle arrangement comprising: a handle member; and, a squeeze-actuated vent valve arrangement configured to have: a first, open, squeezed orientation in which the vent arrangement is open to permit a passage of air through the main cover body; and, a second, closed, release orientation in which the vent arrangement is closed to the passage of air through the main cover body; and a deflectable outer seal arrangement oriented in extension around the outer perimeter of the main cover body; the deflectable outer seal arrangement including a deflectable perimeter flange arrangement having a rest shape extending non-orthogonal to a direction between the exterior and interior surfaces of the main cover body.

2. An internal cover/vent assembly comprising: a main cover body having: an outer perimeter; and, opposite exterior and interior surfaces; a vent arrangement extending through the main cover body; a vent handle arrangement comprising: a squeeze-actuated vent valve arrangement configured to have: a first, open, squeezed orientation in which the vent arrangement is open to permit a passage of air through the main cover body; and, a second, closed, release orientation in which the vent arrangement is closed to the passage of air through the main cover body; and a deflectable outer seal arrangement oriented in extension around the outer perimeter of the main cover body.

3. An internal cover/vent assembly comprising: a main cover body having: an outer perimeter; and, opposite exterior and interior surfaces; a vent arrangement extending through the main cover body; a vent handle arrangement; and a deflectable outer seal arrangement oriented in extension around the outer perimeter of the main cover body; the deflectable outer seal arrangement including a deflectable perimeter flange arrangement having a rest shape extending non-orthogonal to a direction between the exterior and interior surfaces of the main cover body.

4. A method of venting a container, comprising: squeezing a vent handle arrangement configured on an internal cover; and pushing the internal cover along an inside of a container with a slanted sidewall while the internal cover is in sealing engagement with the slanted sidewall.

The above is a description of example principles. Many embodiments can be made using these principles.

What is claimed is:

1. An internal cover/vent handle arrangement for enclosing contents in a container, the internal cover/vent handle arrangement comprising:

(a) a main cover body having: an outer perimeter; and, opposite exterior and interior surfaces;

(b) a vent arrangement extending through the main cover body;

(c) a vent handle arrangement comprising: a stationary handle member; and, a squeeze-actuated vent valve arrangement including a movable squeeze-actuated valve member position between a portion of the stationary handle member and the vent arrangement, the vent valve arrangement configured to have:

(i) a first, open, squeezed orientation in which the vent arrangement is open to permit a passage of air through the main cover body; and, (ii) a second, closed, release orientation in which the vent arrangement is closed to the passage of air through the main cover body; and (d) a deflectable outer seal arrangement oriented in extension around the outer perimeter of the main cover body;

(i) the deflectable outer seal arrangement including a deflectable perimeter flange arrangement having a rest shape extending non-orthogonal to a direction between the exterior and interior surfaces of the main cover body;

wherein the stationary handle member and the moveable, squeeze-actuated, valve member are configured such that a user simultaneously gripping the stationary handle member and the moveable, squeeze-actuated, valve member together can: squeeze to move the vent handle arrangement to the first, open, squeezed orientation; and, release to move the deflectable outer seal arrangement.

2. An internal cover/vent handle arrangement according to claim 1 wherein:

(a) the outer perimeter of the main cover body extends around a central axis, the central axis being perpendicular to a center plane of the main cover body between the opposite exterior and interior surfaces; and, (b) the deflectable perimeter flange arrangement forms an upper acute angle of extension, in the rest shape, relative to the central axis.

3. An internal cover/vent handle arrangement according to claim 2 wherein:

(a) the upper acute angle of extension, in the rest shape, of the deflectable perimeter flange arrangement, is within the range of 10° to 80°, inclusive.

4. An internal cover/vent handle arrangement according to claim 1 wherein:

(a) the deflectable perimeter flange arrangement has a radial outward dimension of extension of at least 10 mm.

5. An internal cover/vent handle arrangement according to claim 1 wherein:

(a) the deflectable perimeter flange arrangement has a radial outward dimension of extension of no more than 80 mm.

6. An internal cover/vent handle arrangement according to claim 1 wherein:

(a) the deflectable perimeter flange arrangement comprises a unitary skirt member having a thickness within the range of 0.01 mm to 5 mm.

7. An internal cover/vent handle arrangement according to claim 1 wherein:

(a) the deflectable perimeter flange arrangement has an upper surface; and, an opposite, lower, sealing surface; the lower sealing surface comprising a plurality of radial ribs.

8. An internal cover/vent handle arrangement according to claim 1 wherein:

(a) the main cover body has a circular perimeter.

9. An internal cover/vent handle arrangement according to claim 1 wherein:

(a) the deflectable perimeter flange arrangement has an outer remote end defining a circular shape.

10. An internal cover/vent handle arrangement according to claim 1 wherein:

(a) the main cover body has an outer perimeter wall; and (b) the deflectable perimeter flange arrangement comprises a portion of a seal member having an attachment base;

(i) the attachment base surrounding, and being secured to, the outer perimeter wall; and, (ii) the deflectable perimeter flange arrangement being integral with the attachment base.

11. An internal cover/vent handle arrangement according to claim 1 wherein:

(a) the main cover body includes an upper end and a central surface portion, the central surface portion being recessed relative to the upper end of the main cover body.

12. An internal cover/vent handle arrangement according to claim 10 wherein:

(a) the outer perimeter wall of the main cover body includes an upper, radially outwardly extending, projection and a lower, radially outwardly extending, projection with a peripheral, recessed, groove therebetween;

(i) the attachment base being secured in the recessed groove.

13. An internal cover/vent handle arrangement according to claim 1 wherein:

(a) the stationary handle member defines a handle bridge extending between two opposite supports.

14. An internal cover/vent handle arrangement according to claim 1 including:

(a) a biasing arrangement configured to bias the moveable, squeeze-actuated, valve member to a second, closed, orientation when released;

(b) the moveable, squeeze-actuated, valve member including at least one seal pad configured to be biased against at least a portion of the vent arrangement when the vent handle arrangement is in the second, closed, release orientation.

15. An internal cover/vent assembly comprising:

(a) a main cover body having: an outer perimeter; and, opposite exterior and interior surfaces;

(b) a vent arrangement extending through the main cover body;

(c) a vent handle arrangement comprising: a stationary handle member and a moveable squeeze-actuated vent valve arrangement configured to have:

(i) a first, open, squeezed orientation in which the vent arrangement is open to permit a passage of air through the main cover body; and, (ii) a second, closed, release orientation in which the vent arrangement is closed to the passage of air through the main cover body;

wherein the squeeze-actuated vent valve arrangement includes a moveable, squeeze-actuated, valve member positioned between a portion of the stationary handle member and the vent valve arrangement; and (d) a deflectable outer seal arrangement oriented in extension around the outer perimeter of the main cover body;

wherein the stationary handle member and the moveable, squeeze-actuated, valve member are configured such that a user simultaneously gripping the stationary handle member and the moveable, squeeze-actuated, valve member together can: squeeze to move the vent handle arrangement to the first, open, squeezed orientation; and, release to move the deflectable outer seal arrangement.

16. An internal cover/vent assembly according to claim 15 wherein:

(a) the deflectable outer seal arrangement includes a deflectable perimeter flange arrangement having a rest shape extending at an acute angle to a direction between the exterior and interior surfaces of the main cover body.

* * * * *